US011170715B2

(12) United States Patent
Huangfu et al.

(10) Patent No.: US 11,170,715 B2
(45) Date of Patent: Nov. 9, 2021

(54) PIXEL CIRCUIT, DISPLAY PANEL, DISPLAY DEVICE AND DRIVING METHOD

(71) Applicant: BOE Technology Group Co., Ltd., Beijing (CN)

(72) Inventors: Lujiang Huangfu, Beijing (CN); Can Zheng, Beijing (CN); Yunfei Li, Beijing (CN); Libin Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 659 days.

(21) Appl. No.: 15/751,267

(22) PCT Filed: Jun. 20, 2017

(86) PCT No.: PCT/CN2017/089173
§ 371 (c)(1),
(2) Date: Feb. 8, 2018

(87) PCT Pub. No.: WO2018/090620
PCT Pub. Date: May 24, 2018

(65) Prior Publication Data

US 2020/0202782 A1 Jun. 25, 2020

(30) Foreign Application Priority Data

Nov. 18, 2016 (CN) ..... 201611014202.7

(51) Int. Cl.
*G09G 3/3258* (2016.01)
*G09G 3/3291* (2016.01)
(Continued)

(52) U.S. Cl.
CPC ..... *G09G 3/3258* (2013.01); *G09G 3/3233* (2013.01); *G09G 3/3275* (2013.01);
(Continued)

(58) Field of Classification Search
CPC .... G09G 3/3233; G09G 3/3208; G09G 3/325; G09G 2300/0819; G09G 2300/0842;
(Continued)

(56) References Cited

U.S. PATENT DOCUMENTS 5,949,270 A 9/1999 Saito
6,229,506 B1 5/2001 Dawson et al.
(Continued)

FOREIGN PATENT DOCUMENTS

CN 101192374 A 6/2008
CN 101409041 A 4/2009
(Continued)

OTHER PUBLICATIONS

Sep. 5, 2017—(WO) International Search Report and Written Opinion Appn PCT/CN2017/089173 with English Tran.
(Continued)

*Primary Examiner* — Dismery Mercedes
(74) *Attorney, Agent, or Firm* — Banner & Witcott, Ltd.

(57) ABSTRACT

A pixel circuit, a display panel, a display device and a driving method are provided. The pixel circuit includes: a driving transistor, a first transistor, a first capacitor, the organic light-emitting diode and a switching induced error compensation circuit. The switching induced error compensation circuit is connected with a first node and/or a second node and is configured to compensate a switching induced error of the first transistor.

17 Claims, 7 Drawing Sheets

(51) Int. Cl.
*G09G 3/3233* (2016.01)
*G09G 3/3275* (2016.01)

(52) U.S. Cl.
CPC ..... *G09G 3/3291* (2013.01); *G09G 2300/043* (2013.01); *G09G 2300/0819* (2013.01); *G09G 2310/0251* (2013.01)

(58) Field of Classification Search
CPC ..... G09G 2320/0233; G09G 2320/025; G09G 2320/045; G09G 2310/0251; G09G 3/3291; G09G 3/3258; G09G 2300/043; G09G 2300/0866; G09G 2320/043; G09G 2320/0223; H01L 27/14609; H01L 27/14612; H01L 27/3276; H01L 27/3265
See application file for complete search history.

(56) References Cited

U.S. PATENT DOCUMENTS

| | | | | |
|---|---|---|---|---|
| 7,365,742 | B2 | 4/2008 | Kim et al. | |
| 7,978,156 | B2 * | 7/2011 | Kim | G09G 3/3233 345/76 |
| 8,564,513 | B2 * | 10/2013 | Nathan | G09G 3/3233 345/82 |
| 8,766,963 | B2 * | 7/2014 | Lee | G09G 3/3291 345/211 |
| 10,242,622 | B2 * | 3/2019 | Tseng | G09G 3/325 |
| 10,565,932 | B2 * | 2/2020 | Zhang | G09G 3/3233 |
| 2003/0030603 | A1 | 2/2003 | Shimoda | |
| 2007/0040772 | A1 * | 2/2007 | Kim | G09G 3/3233 345/76 |
| 2008/0150847 | A1 * | 6/2008 | Kim | G09G 3/3233 345/82 |
| 2011/0018855 | A1 * | 1/2011 | Miyazawa | G09G 3/3291 345/211 |
| 2011/0157135 | A1 * | 6/2011 | Lee | G09G 3/3291 345/211 |
| 2013/0088417 | A1 * | 4/2013 | Kim | G09G 3/3233 345/82 |
| 2014/0139502 | A1 * | 5/2014 | Han | G09G 3/3233 345/212 |
| 2015/0187266 | A1 * | 7/2015 | Qian | G09G 3/3233 345/77 |
| 2015/0310804 | A1 * | 10/2015 | Ma | G09G 3/3208 345/212 |
| 2015/0356924 | A1 * | 12/2015 | Chen | G09G 3/3258 345/690 |
| 2016/0042694 | A1 * | 2/2016 | Lim | G09G 3/3233 345/78 |
| 2016/0063923 | A1 * | 3/2016 | Yang | G09G 3/3258 345/211 |
| 2016/0148566 | A1 * | 5/2016 | Tseng | G09G 3/3233 345/212 |
| 2016/0232840 | A1 * | 8/2016 | Tseng | G09G 3/3225 |
| 2016/0307504 | A1 * | 10/2016 | Hung | G09G 3/3233 |
| 2016/0372049 | A1 | 12/2016 | Wang et al. | |
| 2017/0025062 | A1 * | 1/2017 | Wang | G09G 3/3233 |
| 2017/0270860 | A1 * | 9/2017 | Wang | G09G 3/3233 |
| 2017/0330511 | A1 | 11/2017 | Feng | |
| 2018/0130412 | A1 * | 5/2018 | Zhang | G09G 3/3258 |
| 2018/0190185 | A1 | 7/2018 | Ko et al. | |
| 2018/0357962 | A1 | 12/2018 | Feng | |

FOREIGN PATENT DOCUMENTS

| | | | |
|---|---|---|---|
| CN | 103927975 | A | 7/2014 |
| CN | 104157240 | A | 11/2014 |
| CN | 104537983 | A | 4/2015 |
| CN | 104680977 | A | 6/2015 |
| CN | 105161051 | A | 12/2015 |
| CN | 105679236 | A | 6/2016 |
| CN | 105976758 | A | 9/2016 |
| CN | 106067291 | A | 11/2016 |
| CN | 206194348 | U | 5/2017 |
| CN | 207818163 | U | 9/2018 |

OTHER PUBLICATIONS

Keum, et al., "A Pixel Structure Using Switching Error Reduction Method for High Image Quality AMOLED Displays", SID 2015 Digest, pp. 57-60.

Sheu, et al., "Switch-Induced Error Voltage on a Switched Capacitor", IEEE Journal of Solid-State Circuits, vol. SC-19, No. 4, Aug. 1984, pp. 519-525.

Suarez, et al., "All-MOS Charge Redistribution Analog-to-Digital Conversion Techniques—Part II", IEEE Journal of Solid-State Circuits, vol. SC-10, No. 6, Dec. 1975, pp. 379-385.

Mar. 20, 2019—(CN) First Office Action Appn 201611014202.7 with English Translation.

* cited by examiner

PIXEL CIRCUIT, DISPLAY PANEL, DISPLAY DEVICE AND DRIVING METHOD

The application is a U.S. National Phase Entry of International Application No. PCT/CN2017/089173 filed on Jun. 20, 2017, designating the United States of America and claiming priority to Chinese Patent Application No. 201611014202.7, filed on Nov. 18, 2016. The present application claims priority to and the benefit of the above-identified applications and the above-identified applications are incorporated by reference herein in their entirety.

TECHNICAL FIELD

Embodiments of the present disclosure relates to a pixel circuit, a display panel, a display device and to a driving method.

BACKGROUND

In display field, organic light-emitting diode (OLED) display panels have broad development prospects because they possess characteristics such as self-illumination, high contrast, low consumption, broad view angle, rapid response speed, compatibility for a flexible panel, wide applicable temperature range, simple manufacturing process and so on.

Due to the above-mentioned characteristics, organic light-emitting diode (OLED) display panel can be applied in devices having display functions such as cellphones, display devices, laptops, digital cameras, instruments and apparatus and so on.

SUMMARY

At least one embodiment of the present disclosure provides a pixel circuit, comprising: a driving transistor, a first transistor, a first capacitor, an organic light-emitting diode and a switching induced error compensation circuit. The driving transistor comprises a first end connected with a first power line to receive a first power voltage, a gate electrode connected with a first node, and a second end connected with a second node. The first transistor comprises a first end connected with the second node, a gate electrode connected with a first control signal line to receive a first control signal, and a second end connected with the first node. The first capacitor comprises a first end connected with the first node and a second end connected with a third node. The organic light-emitting diode is configured to emit light driven by the driving transistor in operation. The switching induced error compensation circuit is connected with the first node and/or the second node and is configured to compensate a switching induced error of the first transistor.

For example, in the pixel circuit provided by one example of the present disclosure, the switching induced error compensation circuit comprises a first compensation transistor; a first end and/or a second end of the first compensation transistor is connected with the first node, and a gate electrode of the first compensation transistor is connected with a light-emitting control signal line to receive a light-emitting control signal.

For example, in the pixel circuit provided by one example of the present disclosure, the first compensation transistor and the first transistor are formed by a same process.

For example, in the pixel circuit provided by one example of the present disclosure, the switching induced error compensation circuit comprises a compensation capacitor; a first end of the compensation capacitor is connected with the first node, and a second end of the compensation capacitor is connected with the second node.

For example, in the pixel circuit provided by one example of the present disclosure, the switching induced error compensation circuit comprises a second compensation transistor; a first end of the second compensation transistor is connected with the second node, a second end of the second compensation transistor is connected with a discharge voltage line to receive a discharge voltage, and a gate electrode of the second compensation transistor is connected with a compensation control signal line to receive a compensation control signal.

For example, the pixel circuit provided by one example of the present disclosure further comprises a data write circuit that is configured to receive the first control signal and a data signal, and write the data signal into the third node according to the first control signal.

For example, in the pixel circuit provided by one example of the present disclosure, the data write circuit comprises a second transistor. A first end of the second transistor is connected with a data signal line to receive the data signal, a second end of the second transistor is connected with the third node, and a gate electrode of the second transistor is connected with the first control signal line to receive the first control signal.

For example, the pixel circuit provided by one example of the present disclosure further comprises a first reference voltage write circuit that is configured to receive a light-emitting control signal and a first reference voltage, and to write the first reference voltage into the third node according to the light-emitting control signal.

For example, in the pixel circuit provided by one example of the present disclosure, the first reference voltage write circuit comprises a third transistor. A first end of the third transistor is connected with a first reference voltage line to receive the first reference voltage, a second end of the third transistor is connected with the third node, and a gate electrode of the third transistor is connected with a light-emitting control signal line to receive the light-emitting control signal.

For example, the pixel circuit provided by one example of the present disclosure further comprises a light-emitting control circuit that is configured to receive a light-emitting control signal, and to control the organic light-emitting diode to emit light according to the light-emitting control signal.

For example, in the pixel circuit provided by one example of the present disclosure, the light-emitting control circuit comprises a fourth transistor. A first end of the fourth transistor is connected with the second node, a second end of the fourth transistor is connected with a fourth node, and a gate electrode of the fourth transistor is connected with a light-emitting control signal line to receive the light-emitting control signal; and the organic light-emitting diode comprises a first end connected with the fourth node and a second end connected with a second power line to receive a second power voltage.

For example, the pixel circuit provided by one example of the present disclosure further comprises a second reference voltage write circuit that is configured to receive a second control signal and a second reference voltage, and write the second reference voltage into the third node according to the second control signal.

For example, in the pixel circuit provided by one example of the present disclosure, the second reference voltage write circuit comprises a fifth transistor. A first end of the fifth transistor is connected with a second reference voltage line to receive the second reference voltage, a second end of the fifth transistor is connected with third node, and a gate electrode of the fifth transistor is connected with a second control signal to receive the second control signal.

For example, the pixel circuit provided by one example of the present disclosure further comprises a discharge circuit that is configured to receive a second control signal and a discharge voltage, and to write the discharge voltage into the first node according to the second control signal.

For example, in the pixel circuit provided by one example of the present disclosure, the discharge circuit comprises a sixth transistor. A first end of the sixth transistor is connected with the first node, a second end of the sixth transistor is connected with a discharge voltage line to receive the discharge voltage, and a gate electrode of the sixth transistor is connected with a second control signal line to receive the second control signal.

For example, the pixel circuit provided by one example of the present disclosure further comprises a second capacitor. A first end of the second capacitor is connected with the first power line to receive the first power voltage, and a second end of the second capacitor is connected with the first node.

At least one embodiment of the present disclosure further provides a display panel comprising the pixel circuit provided by any one embodiment of the present disclosure.

At least one embodiment of the present disclosure further provides a display device comprising the display panel provided by any one embodiment of the present disclosure.

At least one embodiment of the present disclosure further provides a driving method of the pixel circuit provided by any one embodiment of the present disclosure, comprising a reset period, a data write period, a switching induced error compensation period and a light-emitting period. During the reset period, the first node is reset; during the data write period, a data signal is written in; during the switching induced error compensation period, the switching induced error of the first transistor is compensated; and during the light-emitting period, the organic light-emitting diode is driven to emit light.

For example, in the driving method provided by one embodiment of the present disclosure, the pixel circuit comprises a driving transistor comprising a first end connected with a first power line to receive a first power voltage, a gate electrode connected with a first node, and a second end connected with a second node. The pixel circuit further comprises a first transistor comprising a first end connected with the second node, a gate electrode connected with a first control signal line to receive a first control signal, and a second end connected with the first node. The pixel circuit further comprises a first capacitor comprising a first end connected with the first node and a second end connected with a third node; an organic light-emitting diode that is configured to emit light driven by the driving transistor in operation. The switching induced error compensation circuit comprises a first compensation transistor. A first end and a second end of the first compensation transistor is connected with the first node, and a gate electrode of the first compensation transistor is connected with a light-emitting control signal line to receive a light-emitting control signal. During the data write period, the first control signal is a switching-on voltage and the light-emitting control signal is a switching-off voltage; during the switching induced error compensation period, the first control signal is a switching-off voltage and the light-emitting control signal is a switching-off voltage; and during the light-emitting period, the first control signal is a switching-off voltage and the light-emitting control signal is a switching-on voltage.

For example, in the driving method provided by one example of the present disclosure, the pixel circuit comprises a driving transistor comprising a first end connected with a first power line to receive a first power voltage, a gate electrode connected with a first node, and a second end connected with a second node. The pixel circuit further comprises a first transistor comprising a first end connected with the second node, a gate electrode connected with a first control signal line to receive a first control signal, and a second end connected with the first node. The pixel circuit further comprises a first capacitor comprising a first end connected with the first node and a second end connected with a third node; the organic light-emitting diode that is configured to emit light driven by the driving transistor in operation; and a switching induced error compensation circuit. The switching induced error compensation circuit comprises a compensation capacitor. A first end of the compensation capacitor is connected with the first node, and a second end of the compensation capacitor is connected with the second node. During the data write period, the first control signal is a switching-on voltage and the light-emitting control signal is a switching-off voltage; during the switching induced error compensation period, the first control signal is a switching-off voltage and the light-emitting control signal is a switching-off voltage; and during the light-emitting period, the first control signal is a switching-off voltage and the light-emitting control signal is a switching-on voltage.

For example, in the driving method provided by one example of the present disclosure, the pixel circuit comprises a driving transistor comprising a first end connected with a first power line to receive a first power voltage, a gate electrode connected with a first node, and a second end connected with a second node. The pixel circuit further comprises a first transistor comprising a first end connected with the second node, a gate electrode connected with a first control signal line to receive a first control signal, and a second end connected with the first node. The pixel circuit further comprises a first capacitor comprising a first end connected with the first node and a second end connected with a third node; the organic light-emitting diode that is configured to emit light driven by the driving transistor in operation; and a switching induced error compensation circuit. The switching induced error compensation circuit comprises a second compensation transistor. A first end of the second compensation transistor is connected with the second node, a second end of the second compensation transistor is connected with a discharge voltage line to receive a discharge voltage, and a gate electrode of the second compensation transistor is connected with a compensation control signal line to receive a compensation control signal. During the data write period, the first control signal is a switching-on voltage, the light-emitting control signal is a switching-off voltage, and the compensation control signal is a switching-off voltage; during the switching induced error compensation period, the first control signal is a switching-off voltage, the light-emitting control signal is a switching-off voltage, and the compensation control signal is a switching-on voltage; and during the light-emitting period, the first control signal is a switching-off voltage, the light-emitting control signal is a switching-on voltage, and the compensation control signal is a switching-off voltage.

For example, in the driving method provided by one example of the present disclosure, when the first control signal changes from a switching-on voltage to a switching-off voltage, the compensation control signal changes from a switching-off voltage to a switching-on voltage concurrently.

For example, pixel circuits, display panels, display devices and driving methods provided by embodiments of the present disclosure can reduce or eliminate the switching induced error during the compensating of the threshold voltage and improve the display uniformity of the display panel.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
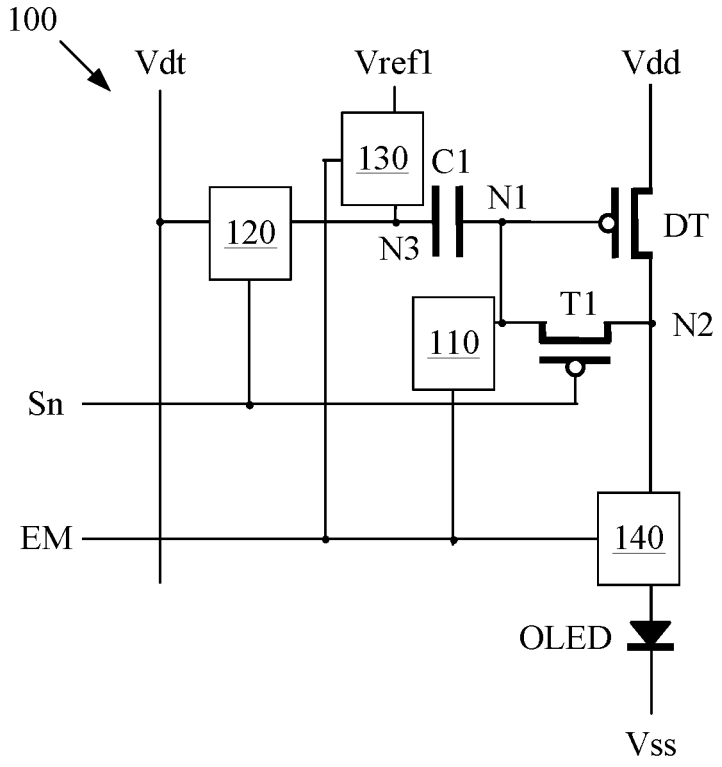
FIG. 1 is a first schematic view of a pixel circuit provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. It should be noted that the drawings are not drawn in a real scale. Descriptions about the known materials, components and process technologies are omitted in the present disclosure in order not to render embodiments of the present disclosure obscure. The given examples aim to help to understand implementation of embodiments of the present disclosure, and further to enable the skilled person in the art to implement the example of the embodiments. Therefore, these examples cannot be interpreted as limitative to the scope of the embodiments of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Besides, same or similar reference numbers are used to indicate same or similar components.

In an organic light-emitting diode (OLED) display panel, threshold voltages of driving transistors in different pixel units differ from each other because of manufacturing process. Additionally, the threshold voltages of the driving transistors may drift due to influences such as temperature variation. Differences of threshold voltages among diving transistors may cause a non-uniformity display of the display panel. Therefore, threshold voltages of diving transistors need to be compensated.

A traditional threshold voltage compensation circuit usually comprises a short transistor. The source electrode of the short transistor is connected with the drain electrode of the driving transistor and the drain electrode of the short transistor is connected with the gate electrode of the driving transistor. This setting manner cooperating with a corresponding driving sequence allows the driving transistor to be shorted in a configuration of diode during the compensation, so as to realize the compensation of the threshold voltage of the driving transistor. However, the effect of this compensation method is not ideally good, and one important reason is that a capacitor holding potential error is caused upon the switching off of the short transistor during the operation of the threshold voltage compensation circuit, and the error is called as a switching induced error.

The reason causing the switching induced error lies in an equivalent capacitor (comprising overlapping electrode parasitic capacitance and channel capacitance) between the gate electrode and the drain electrode of the short transistor. When charging to the storage capacitor finishes, the potential of an end of the storage capacitor is the threshold voltage of the driving transistor, which end is connected with the gate electrode of the driving transistor. During the switching off of the short transistor, electrons stored in the equivalent capacitor of the short transistor are injected into the storage capacitor due to the change of the bias voltage and the capacitance and cause an error to the threshold voltage signal held in the short transistor.

As a result, threshold voltage non-uniformity caused by the switching induced error is still a main factor that restricts the yield of organic light-emitting diode display panels, and the switching induced error needs to be compensated.

Figure 14:
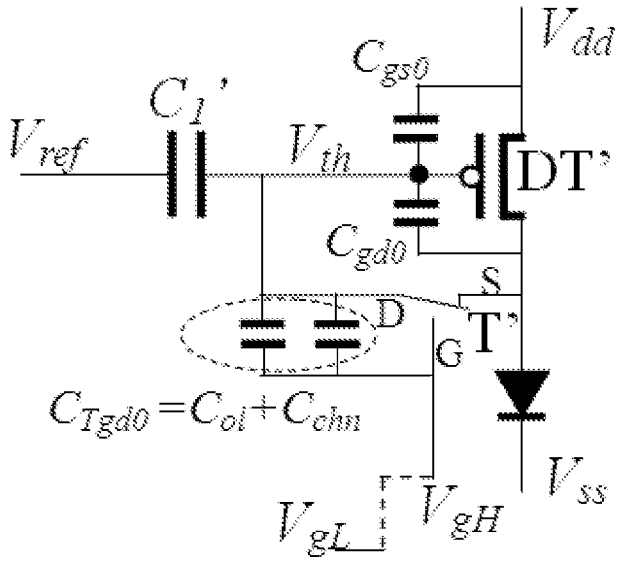
FIG. 14 is a state diagram of a short switch transistor after charging for a threshold voltage before switching off.
Figure 15:
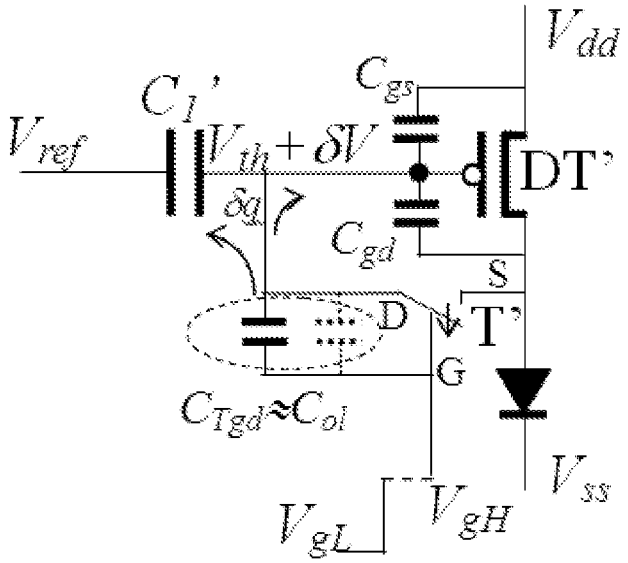
FIG. 15 is a state diagram of a short switch transistor after sample charging for a threshold voltage before switching off.

For example, the reason for the switching induced error is explained in connection with FIG. 14 and FIG. 15. FIG. 14 is a state diagram of a short switch transistor after charging for a threshold voltage before switching off and FIG. 15 is a state diagram of a short switch transistor after sample charging for a threshold voltage before switching off. An equivalent capacitor CTgd0 exists between the gate electrode and the drain electrode of the short switch transistor T', comprising overlapping electrode parasitic capacitance Col and channel capacitance Cchn. When the storage capacitor finishes charging, the potential of an end of the storage capacitor is the threshold voltage Vth of the driving transistor DT', which end is connected with the gate electrode of the driving transistor DT'. During the switching off of the short transistor T', electrons stored in the capacitor CTgd0 of the short transistor are injected into the storage capacitor C1' due to the change of the bias voltage and the capacitance, which causes an error to the threshold voltage Vth signal held in the short transistor. In a condition without considering capacitance of other related transistor(s), the related charge conservation equation can be solved to get the potential of the gate electrode of the driving transistor DT' after the short transistor T' switches off:

$$V_{DTgs} = V_{th} + \delta V = V_{th} - \frac{C_{gs} + C_{gd} - C_{gs0} + C_{Tgd} - C_{Tgd0}}{C_1 + C_{gs} + C_{gd} + C_{Tgd}} V_{th} + \frac{C_1(V_{ref} - V_{dd}) + C_{gd}(V_{ss} + V_{op}) + C_{Tgd}V_{gH} - C_{Tgd0}V_{gL}}{C_1 + C_{gs} + C_{gd} + C_{Tgd}} \approx V_{th} - \frac{C_{gs} - C_{gz0} + C_{gd} - C_{chn}}{C_1 + C_{gs} + C_{gd} + C_{ol}} + \frac{C_1(V_{ref} - V_{dd}) + C_{gd}(V_{ss} + V_{op}) + C_{ol}V_{gH} - (C_{ol} + C_{chn})V_{gL}}{C_2 + C_{gs} + C_{gd} + C_{ol}}$$

The second item and the third item of the above equation are both the error induced in the switching off of the short transistor T'. The second item is an error related to threshold voltage Vth of the driving transistor DT' and the third item is an error related to the signal of (Vref−Vdt). Vref is a reference voltage, Vdt is a data signal voltage, $V_{gH}$ is a high level voltage, and $V_{gL}$ is a low level voltage. Based on a same working procedure, the current running through the driving transistor DT' is as follows:

$$I_{DT} = K(V_{DTgz} - V_{th})^2 \approx K\left(-\frac{C_{gs} - C_{gs0} + C_{gd} - C_{chn}}{C_1 + C_{gs} + C_{gd} + C_{ol}} V_{th} + \frac{C_1(V_{ref} - V_{dd}) + C_{gd}(V_{ss} + V_{op}) + C_{ol}V_{gH} - (C_{ol} + C_{chn})V_{gL}}{C_2 + C_{gs} + C_{gd} + C_{ol}}\right)^2$$

wherein $$K = 0.5\mu_n Cox\frac{W}{L},$$

$\mu_n$ is the channel mobility of the driving transistor DT', Cox is the channel capacitance per unit area of the driving transistor DT', W and L are the channel with and the channel length respectively, and $V_{DTgs}$ is a gate-source voltage of the driving transistor DT' (i.e., the voltage difference between the gate electrode and the source electrode of the driving transistor DT').

Due to the existence of the item related to the threshold voltage Vth of the driving transistor DT', the non-uniformity of the threshold voltage Vth may still influence the display uniformity. In the threshold voltage Vth related item of the above equation, Cgs and Cgs0 are capacitance produced between the gate electrode and the source electrode of the driving transistor DT' in a turning-on state and in a threshold voltage compensation state respectively. Difference between Cgs and Cgs0 is usually small and have little influence on the threshold voltage Vth. Cgd and Cgd0 are capacitance produced between the gate electrode and the drain electrode of the driving transistor DT' in the turning-on state and in the threshold voltage compensation state respectively, and they have similar features as the capacitances between the gate electrode and the source electrode. However, because Cgd0 is shorted by the short transistor T' and stores no electric charge in the threshold voltage compensation state, Cgd can attract more electric charges after the short transistor T' switches off, so as to exert certain influence on the threshold voltage Vth related error.

It can be seen that the coefficient of the threshold voltage Vth related item of the error is mainly determined by the channel capacitance Cchn of the short transistor T' and the capacitance Cgd between the gate electrode and the drain electrode of the driving transistor DT'. The physical process is as follows: during the switching off process, the conductive channel of the short transistor T' disappears and the corresponding equivalent capacitance is nearly 0; electric charges previously existing within the equivalent capacitor are injected into the storage capacitor C1', and part of the electric charges are absorbed by the capacitances such as Cgd between the gate electrode and the drain electrode of the driving transistor DT'.

For example, embodiments of the present disclosure provide a pixel circuit, a display panel, a display device and a driving method, which can reduce or eliminate the switching induced error during threshold voltage compensation and improve the display uniformity of the display panel.

At least one embodiment of the present disclosure provides a pixel circuit, comprising: a driving transistor, a first transistor, a first capacitor, an organic light-emitting diode and a switching induced error compensation circuit. The driving transistor comprises a first end connected with a first power line to receive a first power voltage, a gate electrode connected with a first node, and a second end connected with a second node. The first transistor comprises a first end connected with the second node, a gate electrode connected with a first control signal line to receive a first control signal, and a second end connected with the first node. The first capacitor comprises a first end connected with the first node and a second end connected with a third node. The organic light-emitting diode is configured to emit light driven by the driving transistor in operation. The switching induced error compensation circuit is connected with the first node and/or the second node and is configured to compensate a switching induced error of the first transistor.

Embodiment One

For example, an embodiment provides a pixel circuit 100. As shown in FIG. 1, the pixel circuit 100 comprises a driving transistor DT, a first transistor T1, a first capacitor C1, an organic light-emitting diode OLED and a switching induced error compensation circuit 110. The driving transistor DT comprises a first end connected with a first power line to receive a first power voltage Vdd, a gate electrode connected with a first node N1, and a second end connected with a second node N2. The first transistor T1 comprises a first end connected with the second node N2, a gate electrode connected with a first control signal line to receive a first control signal Sn, and a second end connected with the first node N1. The first capacitor C1 comprises a first end connected with the first node N1 and a second end connected with a third node N3. The organic light-emitting diode is configured to emit light driven by the driving transistor DT in operation. The switching induced error compensation circuit 110 is connected with the first node N1 and is configured to compensate a switching induced error of the first transistor T1.

It should be noted that all of the transistors adopted in the embodiments of the present disclosure can be thin-film transistors or field effect transistors, or other switch devices with the same characteristics. The source electrodes and the drain electrodes of the transistors adopted here are symmetrical in structure, so the structures of the source electrodes and the drain electrodes have no difference. In embodiments of the present disclosure, in order to distinguish the two ends other than the gate electrode, one end of the two ends is described directly as a first end, and the other end is described as a second end. So the source electrodes and the drain electrodes of some or all of the transistors in the embodiments of the present disclosure can be exchanged according to need. Besides, transistors can be categorized as N-type transistors or P-type transistors, and P-type transistors are taken as an example to illustrate the embodiments of the present disclosure. Based on the illustration and teaching to the implementation of P-type transistors by the present disclosure, those skilled in the art can easily come up with the implementation of N-type transistors without making creative efforts, so the implementation of N-type transistors are within the scope of the protection of the present disclosure as well.

For example, as illustrated in FIG. 1, the pixel circuit 100 provided by the embodiment of the present disclosure further comprises a data write circuit 120. The data write circuit 120 is configured to receive the first control signal Sn and a data signal Vdt, and to write the data signal Vdt into the third node N3 according to the first control signal Sn.

For example, as illustrated in FIG. 1, the pixel circuit 100 provided by the embodiment of the present disclosure further comprises a first reference voltage write circuit 130. The first reference voltage write circuit 130 is configured to receive a light-emitting control signal EM and a first reference voltage Vref1, and to write the first reference voltage Vref1 into the third node N3 according to the light-emitting control signal EM.

For example, as illustrated in FIG. 1, the pixel circuit 100 provided by the embodiment of the present disclosure further comprises a light-emitting control circuit 140. The light-emitting control circuit 140 is configured to receive the light-emitting control signal EM, and to control the organic light-emitting diode OLED to emit light according to the light-emitting control signal EM.

It should be noted that embodiments of the present disclosure comprises but are not limit to cases that the pixel circuit 100 comprises the data write circuit 120, the first reference voltage write circuit 130 and the light-emitting control circuit 140. Other cases can be included, for example, that the data write circuit 120 and the first reference voltage write circuit 130 are not included and the data signal line is directly connected with the third node N3, and meanwhile the time sequence and the voltage value of the data signal Vdt selected to allow the data signal and the first reference voltage to be written in.

Figure 2:
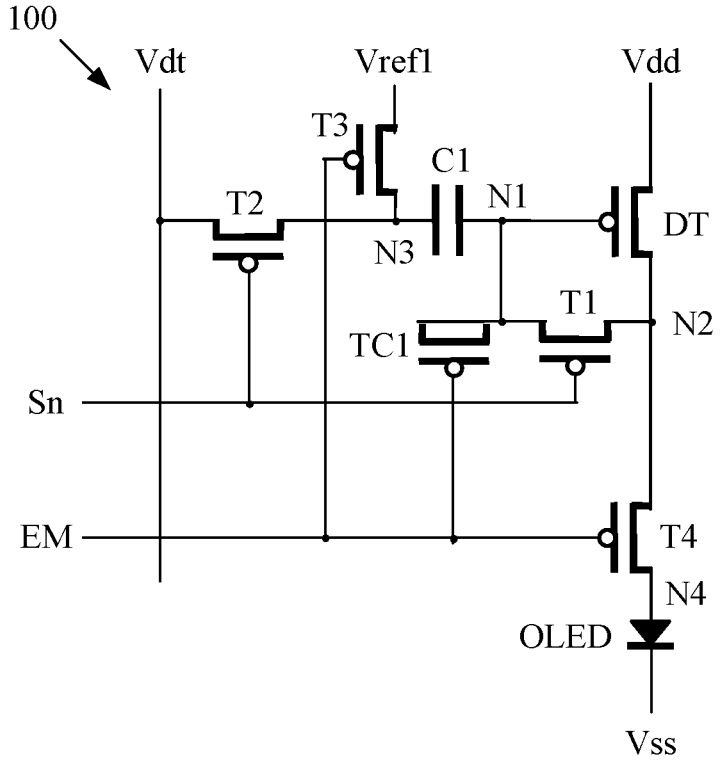
FIG. 2 is a second schematic view of a pixel circuit provided by an embodiment of the present disclosure.

For example, as illustrated in FIG. 1 and FIG. 2, in the pixel circuit 100 provided by the embodiment of the present disclosure, the switching induced error compensation circuit 110 comprises a first compensation transistor TC1. A first end and a second end of the first compensation transistor TC1 are connected with the first node N1, and a gate electrode of the first compensation transistor TC1 is connected with a light-emitting control signal line to receive a light-emitting control signal EM.

It should be noted that embodiments of the present disclosure comprises but are not limit to the case that the first end and a second end of the first compensation transistor TC1 are connected with the first node N1. A case can be that the first end of the first compensation transistor TC1 is connected with the first node N1 and the second end is suspended; or the second end of the first compensation transistor TC1 is connected with the first node N1 and the first end is suspended.

For example, in the pixel circuit 100 provided by the embodiment of the present disclosure, the first compensation transistor TC1 and the first transistor T1 are formed by the same process.

For example, because the first compensation transistor TC1 also has an equivalent capacitor, and at the same time when the first transistor T1 switches off, the electric charges released by the equivalent capacitor between the gate electrode and the drain electrode of the first transistor T1 can be partly or wholly absorbed by the equivalent capacitor of the first compensation transistor TC1, so as to maintain that the threshold voltage stored in the first capacitor C1 is correct and stable. Because the first compensation transistor TC1 and the first transistor T1 are formed by the same process and the characteristics of the first compensation transistor TC1 and the first transistor T1 are same or similar, the equivalent capacitor of the first compensation transistor TC1 can exactly absorb the electric charges released by the equivalent capacitor of the first transistor T1, so that the compensation effect can become good.

For example, the equivalent capacitor of the first compensation transistor TC1 comprises Ctcgs and Ctcgd, in which Ctcgs is the equivalent capacitor between the gate electrode and the source electrode of the first compensation transistor TC1, and Ctcgd is the equivalent capacitor between the gate electrode and the drain electrode of the first compensation transistor TC1 (No matter whether the first end and the second end of the first compensation transistor TC1 are both connected with the first node or not, both Ctcgs and Ctcgd of the first compensation transistor TC1 contribute to absorbing or releasing of the electric charges because of no other bypasses). The equivalent capacitor of the first transistor T1 only comprises the equivalent capacitor C1*gd* between the gate electrode and the drain electrode of the first transistor T1. When the first transistor T1 switches on, total electric charges of the equivalent capacitor C1*gs* between the gate electrode and the drain electrode and the equivalent capacitor C1*gd* between the gate electrode and the drain electrode are constant; when the first transistor T1 switches off, the electric charges are distributed between C1*gd* and C1*gs* according to the bias condition of the circuit, which causes change to the capacitance of the equivalent capacitors C1*gd* and C1*gs*. For example, C1*gd* of the first transistor T1 has larger capacitance than C1*gs*.

For example, for the pixel circuit as illustrated in FIG. 2, only the first control signal Sn and the light-emitting control signal EM are provided for the convenience of layout as well as for improving resolution of the display panel.

For example, as illustrated in FIG. 1 and FIG. 2, in the pixel circuit 100 provided by the embodiment of the present disclosure, the data write circuit 120 comprises a second transistor T2. A first end of the second transistor T2 is connected with the data signal line to receive the data signal Vdt, a second end of the second transistor T2 is connected with the third node N3, and a gate electrode of the second transistor T2 is connected with the first control signal line to receive the first control signal Sn.

For example, as illustrated in FIG. 1 and FIG. 2, in the pixel circuit 100 provided by the embodiment of the present disclosure, the first reference voltage write circuit 130 comprises a third transistor T3. A first end of the third transistor T3 is connected with a first reference voltage line to receive the first reference voltage Vref1, a second end of the third transistor T3 is connected with the third node N3, and a gate electrode of the third transistor T3 is connected with the light-emitting control signal line to receive the light-emitting control signal EM.

For example, as illustrated in FIG. 1 and FIG. 2, in the pixel circuit 100 provided by the embodiment of the present disclosure, the light-emitting control circuit 140 comprises a fourth transistor T4. A first end of the fourth transistor T4 is connected with the second node N2, a second end of the fourth transistor T4 is connected with a fourth node N4, and a gate electrode of the fourth transistor T4 is connected with the light-emitting control signal line to receive the light-emitting control signal EM. The organic light-emitting diode OLED comprises a first end connected with the fourth node N4 and a second end connected with a second power line to receive a second power voltage Vss.

For example, the first power voltage Vdd is a high level voltage (e.g., 8V), and the second power voltage Vss is a low level voltage (e.g., 0V).

For example, the first end of the organic light-emitting diode OLED is the anode, and the second end is the cathode.

It should be noted that the pixel circuit as illustrated in FIG. 2 is only one implementation of the pixel circuit as illustrated in FIG. 1. Embodiments of the present disclosure comprise but are not limited to the implementation as illustrated in FIG. 2.

Figure 3:
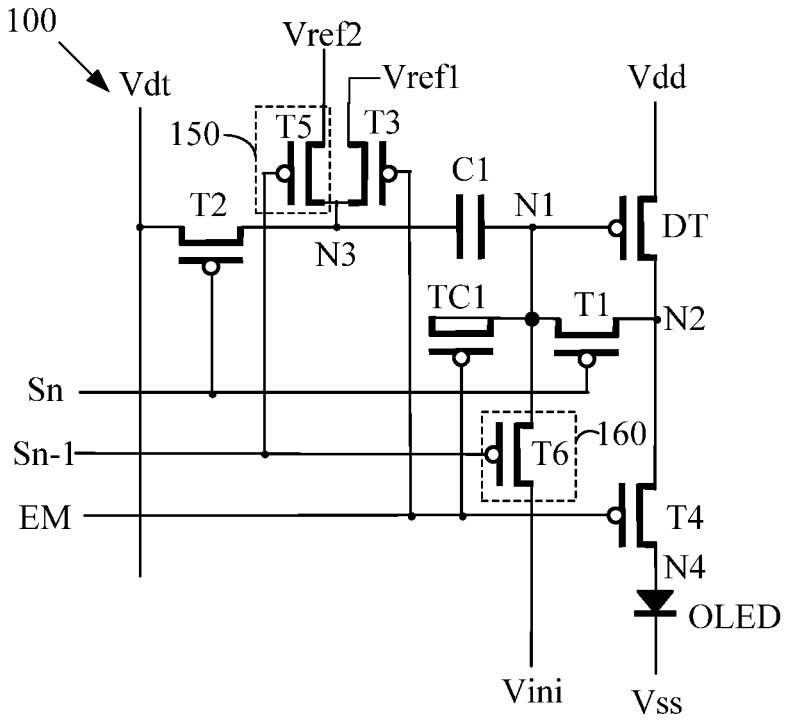
FIG. 3 is a third schematic view of a pixel circuit provided by an embodiment of the present disclosure.

For example, based on the pixel circuit as illustrated in FIG. 2, as illustrated in FIG. 3, the pixel circuit 100 provided by an embodiment of the present disclosure further comprises a second reference voltage write circuit 150. The second reference voltage write circuit 150 is configured to receive a second control signal Sn−1 and a second reference voltage Vref2, and to write the second reference voltage Vref2 into the third node N3 according to the second control signal Sn−1.

For example, as illustrated in FIG. 3, in the pixel circuit 100 provided by the embodiment of the present disclosure, the second reference voltage write circuit 150 comprises a fifth transistor T5; a first end of the fifth transistor T5 is connected with a second reference voltage line to receive the second reference voltage Vref2, a second end of the fifth transistor T5 is connected with the third node N3, and a gate electrode of the fifth transistor T5 is connected with a second control signal to receive the second control signal Sn−1.

For example, the second control signal Sn−1 can be earlier than the first control signal Sn for the time period for scanning one row. That is to say, the second control signal Sn−1 of the pixel circuit of the present row can be realized by the first control signal Sn of the pixel circuit of the previous adjacent row, which can simplify the circuit design and facilitate the circuit layout.

For example, the first reference voltage Vref1 and the second reference voltage Vref2 are stable base voltages and they can be a same voltage or different voltages.

For example, the second reference voltage write circuit 150 is introduced on a base of the first reference voltage write circuit 130 to improve the display quality and to prevent the residual signal of the previous adjacent frame from affecting the signal compensation of the current frame.

For example, as illustrated in FIG. 3, the pixel circuit 100 provided by an embodiment of the present disclosure further comprises a discharge circuit 160. The discharge circuit 160 is configured to receive the second control signal Sn−1 and a discharge voltage Vini, and to write the discharge voltage Vini into the first node N1 according to the second control signal Sn−1.

For example, as illustrated in FIG. 3, in the pixel circuit 100 provided by the embodiment of the present disclosure, the discharge circuit 160 comprises a sixth transistor T6. A first end of the sixth transistor T6 is connected with the first node N1, a second end of the sixth transistor T6 is connected with a discharge voltage line to receive the discharge voltage Vini, and a gate electrode of the sixth transistor T6 is connected with a second control signal line to receive the second control signal Sn−1.

For example, the discharge voltage Vini is a low level voltage (e.g., 0V).

For example, the first reference voltage Vref1, the second reference voltage Vref2 and the discharge voltage Vini can be a same voltage, and this set manner can simplify the circuit design and improve the resolution of the display panel.

Figure 4:
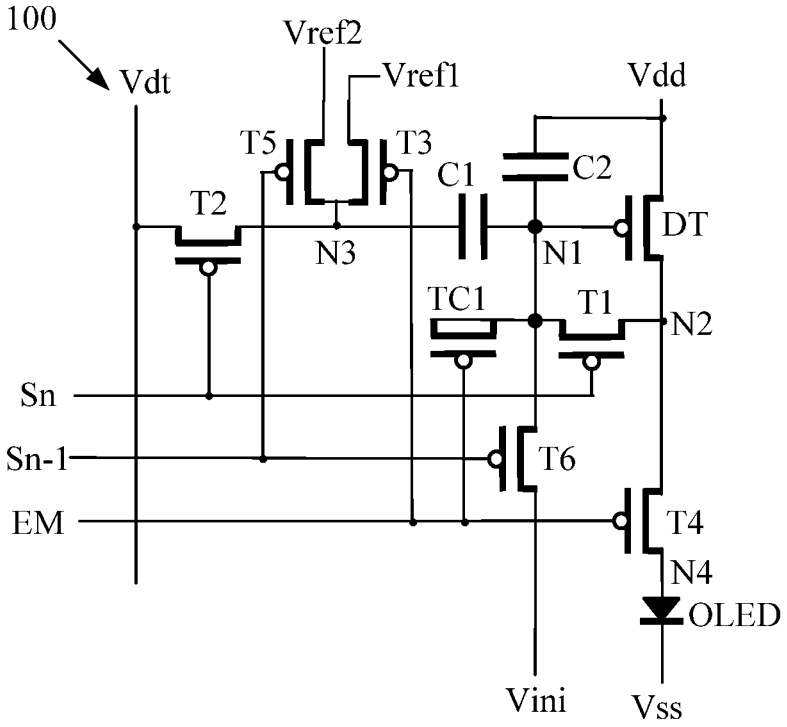
FIG. 4 is a fourth schematic view of a pixel circuit provided by an embodiment of the present disclosure.

For example, on a base of FIG. 3, as illustrated in FIG. 4, the pixel circuit 100 provided by an embodiment of the present disclosure further comprises a second capacitor C2. A first end of the second capacitor 2 is connected with the first power line to receive the first power voltage Vdd, and a second end of the second capacitor C2 is connected with the first node N1.

For example, the second capacitor C2 can be provided to improve the stability of the pixel circuit 100.

Embodiment Two

Figure 5:
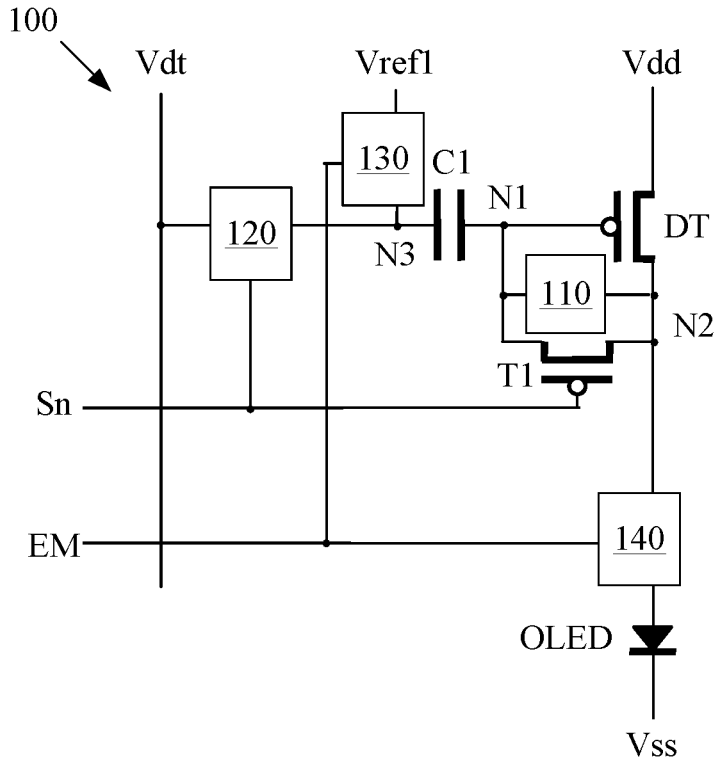
FIG. 5 is a fifth schematic view of a pixel circuit provided by an embodiment of the present disclosure.

For example, the present embodiment of the present disclosure provides a pixel circuit 100. As illustrated in FIG. 5, the pixel circuit 100 further comprises a driving transistor DT, a first transistor T1, a first capacitor C1, an organic light-emitting diode OLED and a switching induced error compensation circuit 110. The driving transistor comprises a first end connected with a first power line to receive a first power voltage Vdd, a gate electrode connected with a first node N1, and a second end connected with a second node N2. The first transistor comprises a first end connected with the second node N2, a gate electrode connected with a first control signal line to receive a first control signal Sn, and a second end connected with the first node N1. The first capacitor C1 comprises a first end connected with the first node N1 and a second end connected with a third node N3. The organic light-emitting diode OLED is configured to emit light driven by the driving transistor DT in operation. The switching induced error compensation circuit 110 is connected with the first node N1 and the second node N2 and is configured to compensate a switching induced error of the first transistor T1.

For example, as illustrated in FIG. 5, the pixel circuit 100 provided by the embodiment of the present disclosure further comprises a data write circuit 120. The data write circuit 120 is configured to receive the first control signal Sn and a data signal Vdt, and to write the data signal Vdt into the third node N3 according to the first control signal Sn.

For example, as illustrated in FIG. 5, the pixel circuit 100 provided by the embodiment of the present disclosure further comprises a first reference voltage write circuit 130. The first reference voltage write circuit 130 is configured to receive a light-emitting control signal EM and a first reference voltage Vref1, and to write the first reference voltage Vref1 into the third node N3 according to the light-emitting control signal EM.

For example, as illustrated in FIG. 5, the pixel circuit 100 provided by the embodiment of the present disclosure further comprises a light-emitting control circuit 140. The light-emitting control circuit 140 is configured to receive the light-emitting control signal EM, and to control the organic light-emitting diode OLED to emit light according to the light-emitting control signal EM.

It should be noted that embodiments of the present disclosure comprises but are not limit to cases that the pixel circuit 100 comprises the data write circuit 120, the first reference voltage write circuit 130 and the light-emitting control circuit 140. Other cases can be included as well.

Figure 6:
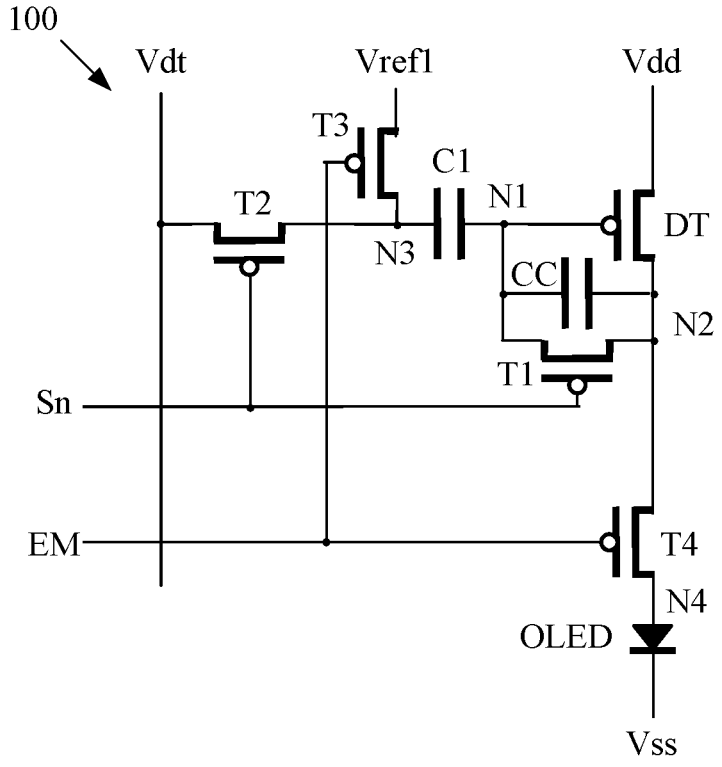
FIG. 6 is a sixth schematic view of a pixel circuit provided by an embodiment of the present disclosure.

For example, as illustrated in FIG. 5 and FIG. 6, in the pixel circuit 100 provided by an embodiment of the present disclosure, the switching induced error compensation circuit 110 comprises a compensation capacitor CC. A first end of the compensation capacitor CC is connected with the first node N1, and a second end of the compensation capacitor CC is connected with the second node N2.

For example, because the compensation capacitor CC is introduced, upon the first transistor T1 switching off, the electric charges released by the equivalent capacitor between the gate electrode and the drain electrode of the first transistor T1 can be partly or wholly absorbed by the equivalent capacitor of the compensation capacitor CC, so as to maintain that the threshold voltage of the first capacitor C1 is correct and stable. The capacitance of the compensation capacitor CC can be obtained through experiments for example.

For example, as illustrated in FIG. 5 and FIG. 6, in the pixel circuit 100 provided by the embodiment of the present disclosure, the data write circuit 120 comprises a second transistor T2. A first end of the second transistor T2 is connected with the data signal line to receive the data signal Vdt, a second end of the second transistor T2 is connected with the third node N3, and a gate electrode of the second transistor T2 is connected with the first control signal line to receive the first control signal Sn.

For example, as illustrated in FIG. 5 and FIG. 6, in the pixel circuit 100 provided by the embodiment of the present disclosure, the first reference voltage write circuit 130 comprises a third transistor T3. A first end of the third transistor T3 is connected with a first reference voltage line to receive the first reference voltage Vref1, a second end of the third transistor T3 is connected with the third node N3, and a gate electrode of the third transistor T3 is connected with the light-emitting control signal line to receive the light-emitting control signal EM.

For example, as illustrated in FIG. 5 and FIG. 6, in the pixel circuit 100 provided by the embodiment of the present disclosure, the light-emitting control circuit 140 comprises a fourth transistor T4. A first end of the fourth transistor T4 is connected with the second node N2, a second end of the fourth transistor T4 is connected with a fourth node N4, and a gate electrode of the fourth transistor T4 is connected with the light-emitting control signal line to receive the light-emitting control signal EM. The organic light-emitting diode OLED comprises a first end connected with the fourth node N4 and a second end connected with a second power line to receive a second power voltage Vss.

It should be noted that the pixel circuit as illustrated in FIG. 6 is only one implementation of the pixel circuit as illustrated in FIG. 5. Embodiments of the present disclosure comprise but are not limited to the implementation as illustrated in FIG. 6.

For example, for the pixel circuit as illustrated in FIG. 6, only the first control signal Sn and the light-emitting control signal EM are provided for the convenience of layout as well as for improving the resolution of the display panel.

For example, in the present embodiment, the pixel circuit can further comprise a second reference voltage write circuit, a discharge circuit and a second circuit and the like (not shown in drawings), of which the implementation is similar to that of the first embodiment, and no description is repeated here.

Embodiment Three

Figure 7:
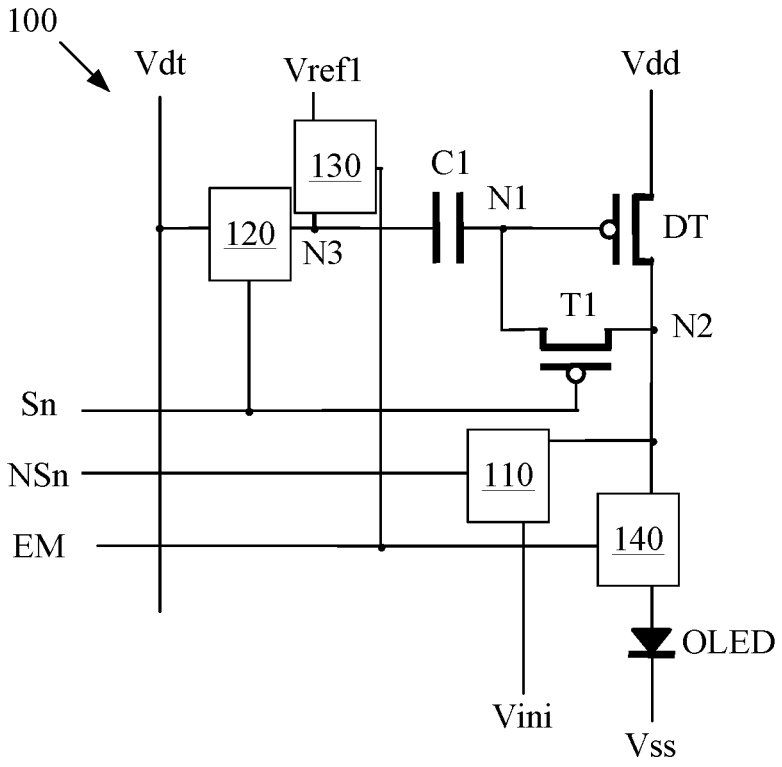
FIG. 7 is a seventh schematic view of a pixel circuit provided by an embodiment of the present disclosure.

For example, the present embodiment of the present disclosure provides a pixel circuit 100. As illustrated in FIG. 7, the pixel circuit 100 further comprises a driving transistor DT, a first transistor T1, a first capacitor C1, an organic light-emitting diode OLED and a switching induced error compensation circuit 110. The driving transistor comprises a first end connected with a first power line to receive a first power voltage Vdd, a gate electrode connected with a first node N1, and a second end connected with a second node N2. The first transistor comprises a first end connected with the second node N2, a gate electrode connected with a first control signal line to receive a first control signal Sn, and a second end connected with the first node N1. The first capacitor C1 comprises a first end connected with the first node N1 and a second end connected with a third node N3. The organic light-emitting diode OLED is configured to emit light driven by the driving transistor DT in operation. The switching induced error compensation circuit 110 is connected with the first node N1 and the second node N2 and is configured to compensate a switching induced error of the first transistor T1.

For example, as illustrated in FIG. 7, the pixel circuit 100 provided by the embodiment of the present disclosure further comprises a data write circuit 120. The data write circuit 120 is configured to receive the first control signal Sn and a data signal Vdt, and to write the data signal Vdt into the third node N3 according to the first control signal Sn.

For example, as illustrated in FIG. 7, the pixel circuit 100 provided by the embodiment of the present disclosure further comprises a first reference voltage write circuit 130. The first reference voltage write circuit 130 is configured to receive a light-emitting control signal EM and a first reference voltage Vref1, and to write the first reference voltage Vref1 into the third node N3 according to the light-emitting control signal EM.

For example, as illustrated in FIG. 7, the pixel circuit 100 provided by the embodiment of the present disclosure further comprises a light-emitting control circuit 140. The light-emitting control circuit 140 is configured to receive the light-emitting control signal EM, and to control the organic light-emitting diode OLED to emit light according to the light-emitting control signal EM.

It should be noted that embodiments of the present disclosure comprises but are not limit to cases that the pixel circuit 100 comprises the data write circuit 120, the first reference voltage write circuit 130 and the light-emitting control circuit 140. Other cases can be included as well.

Figure 8:
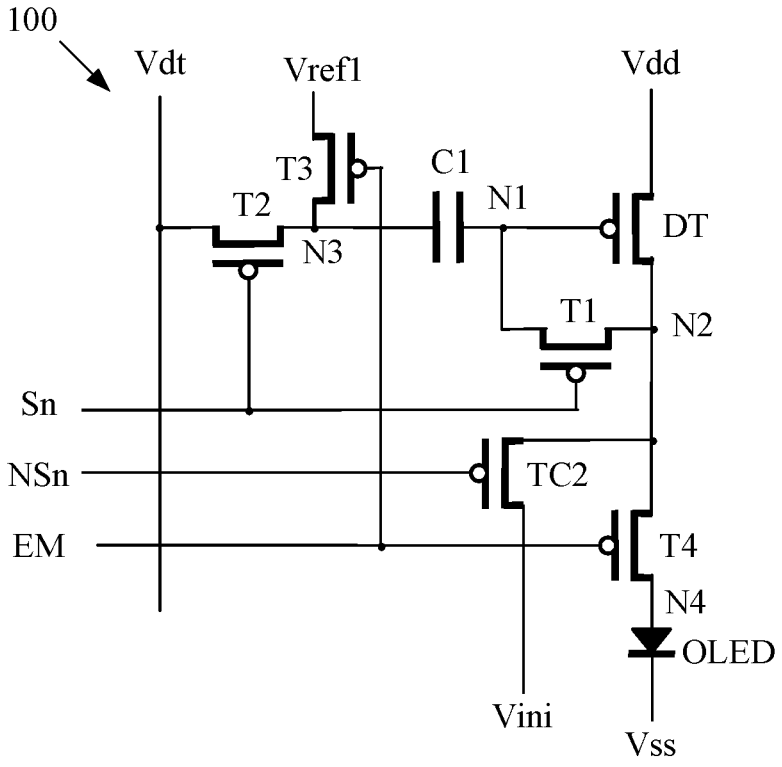
FIG. 8 is an eighth schematic view of a pixel circuit provided by an embodiment of the present disclosure.

For example, as illustrated in FIG. 7 and FIG. 8, in the pixel circuit 100 provided by the embodiment of the present disclosure, the switching induced error compensation circuit 110 comprises a second compensation transistor TC2. A first end of the second compensation transistor TC2 is connected with the second node N2, a second end of the second compensation transistor TC2 is connected with a discharge voltage line to receive a discharge voltage Vini, and a gate electrode of the second compensation transistor TC2 is connected with a compensation control signal line to receive a compensation control signal NSn.

For example, when the first transistor T1 switches off, the second compensation transistor TC2 switches on under the control of a timing controller at the same time. The potential of the first end (e.g., the source electrode) of the first transistor T1 is pulled down to the potential of the discharge voltage Vini (e.g., 0V), which allows the bias voltage across the channel of the first transistor T1 to reverse (the source electrode and the drain electrode are exchanged). In this way, during the disappearing of the channel, most charges in the channel are pushed into the source electrode in the normal operation condition of the first transistor T1, which prevents the threshold voltage held in the first capacitor from being influenced.

For example, as illustrated in FIG. 7 and FIG. 8, in the pixel circuit 100 provided by the embodiment of the present disclosure, the data write circuit 120 comprises a second transistor T2. A first end of the second transistor T2 is connected with the data signal line to receive the data signal Vdt, a second end of the second transistor T2 is connected with the third node N3, and a gate electrode of the second transistor T2 is connected with the first control signal line to receive the first control signal Sn.

For example, as illustrated in FIG. 7 and FIG. 8, in the pixel circuit 100 provided by the embodiment of the present disclosure, the first reference voltage write circuit 130 comprises a third transistor T3. A first end of the third transistor T3 is connected with a first reference voltage line to receive the first reference voltage Vref1, a second end of the third transistor T3 is connected with the third node N3, and a gate electrode of the third transistor T3 is connected with the light-emitting control signal line to receive the light-emitting control signal EM.

For example, as illustrated in FIG. 7 and FIG. 8, in the pixel circuit 100 provided by the embodiment of the present disclosure, the light-emitting control circuit 140 comprises a fourth transistor T4. A first end of the fourth transistor T4 is connected with the second node N2, a second end of the fourth transistor T4 is connected with a fourth node N4, and a gate electrode of the fourth transistor T4 is connected with the light-emitting control signal line to receive the light-emitting control signal EM. The organic light-emitting diode OLED comprises a first end connected with the fourth node N4 and a second end connected with a second power line to receive a second power voltage Vss.

It should be noted that the pixel circuit as illustrated in FIG. 8 is only one implementation of the pixel circuit as illustrated in FIG. 7. Embodiments of the present disclosure comprise but are not limited to the implementation as illustrated in FIG. 8.

For example, in the present embodiment, the pixel circuit can further comprise a second reference voltage write circuit, a discharge circuit and a second circuit and the like (not shown in drawings), of which the implementation is similar to that of the first embodiment, and no description is repeated here.

It should be noted that the implementations of the switching induced error compensation circuits 110 in the first embodiment, the second embodiment and the third embodiment are different, but all can realize the compensation to the switching induced error of the switch transistor T1. Therefore, without conflicts, the implementations of the switching induced error compensation circuits 110 in these embodiments can be used in combination.

Embodiment Four

Figure 9:
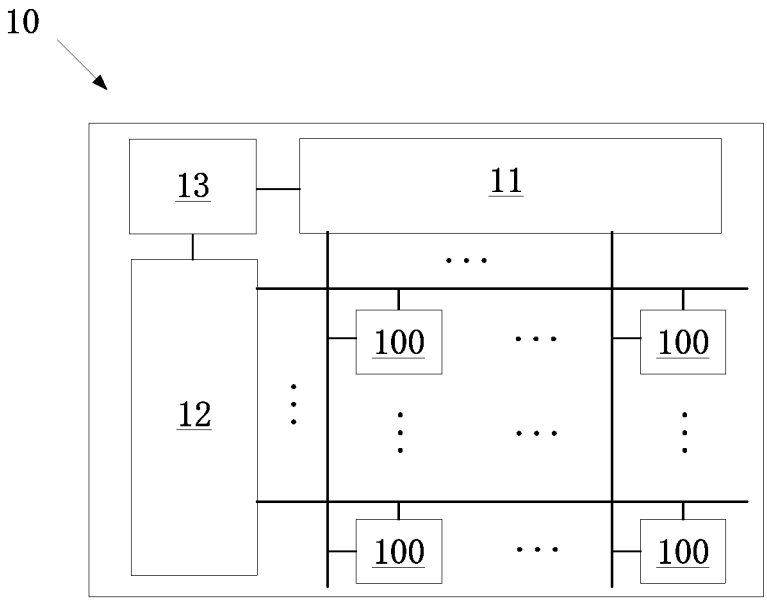
FIG. 9 is a schematic view of a display panel provided by an embodiment of the present disclosure.

The embodiment provides a display panel 10. As illustrated in FIG. 9, the display panel 10 comprises any one pixel circuit 100 provided by any one of the embodiments of the present disclosure.

For example, as illustrated in FIG. 9, the display panel 10 provided by the embodiment further comprises: a data driver 11, a scanning driver 12 and a controller 13. The data driver 11 is configured to provide the data signal Vdt to the pixel circuit 100, the scanning driver 12 is configured to provide the pixel circuit 100 with the light-emitting control signal EM, the first control signal Sn, the second control signal Sn−1 and the compensation control signal Nsn, and the controller 13 is configured to provide instructions to the data driver 11 and the scanning driver 12 so as to allow the data driver 11 and the scanning driver 12 to work cooperatively.

Embodiment Five

Figure 10:
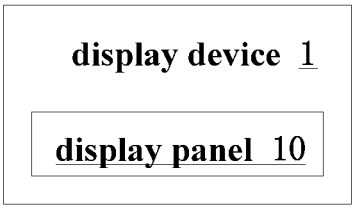
FIG. 10 is a schematic view of a display device provided by an embodiment of the present disclosure.

The embodiment provides a display device 1. As illustrated in FIG. 10, the display device 1 comprises any one display panel provided by any one of the embodiments of the present disclosure.

For example, the display device 1 provided by an embodiment may comprise any product or component having a display function, such as a cellphone, a tablet computer, a television, a display panel, a laptop, a digital photo frame, a navigator and the like.

Embodiment Six

The embodiment provides a driving method of any one pixel circuit 100 provided by any one of the embodiments of the present disclosure. The driving method comprises a reset period t1, a data write period t2, a switching induced error compensation period t3 and a light-emitting period t4. During the reset period t1, the first node N1 is reset; during the data write period t2, the data signal is written in; during the switching induced error compensation period t3, the switching induced error of the first transistor is compensated; and during the light-emitting period t4, the organic light-emitting diode is driven to emit light.

For example, in one example, in the driving method provided by an embodiment of the present disclosure, the pixel circuit as illustrated in FIG. 2 is referred to, that is, the pixel circuit 100 comprises a driving transistor DT, a first transistor T1, a first capacitor C1, an organic light-emitting diode OLED, a switching induced error compensation circuit 110, a data write circuit 120, a first reference voltage write circuit 130 and a light-emitting control circuit 140. The driving transistor DT comprises a first end connected with a first power line to receive a first power voltage Vdd, a gate electrode connected with a first node N1, and a second end connected with a second node N2. The first transistor T1 comprises a first end connected with the second node N2, a gate electrode connected with a first control signal line to receive a first control signal Sn, and a second end connected with the first node N1. The first capacitor C1 comprises a first end connected with the first node N1 and a second end connected with a third node N3. The organic light-emitting diode is configured to emit light driven by the driving transistor DT in operation. The switching induced error compensation circuit 110 comprises a first compensation transistor TC1. A first end and a second end of the first compensation transistor TC1 are connected with the first node N1, and a gate electrode of the first compensation transistor TC1 is connected with a light-emitting control signal line to receive a light-emitting control signal EM. The data write circuit 120 comprises a second transistor T2. A first end of the second transistor T2 is connected with the data signal line to receive the data signal Vdt, a second end of the second transistor T2 is connected with the third node N3, and a gate electrode of the second transistor T2 is connected with the first control signal line to receive the first control signal Sn. The first reference voltage write circuit 130 comprises a third transistor T3. A first end of the third transistor T3 is connected with a first reference voltage line to receive the first reference voltage Vref1, a second end of the third transistor T3 is connected with the third node N3, and a gate electrode of the third transistor T3 is connected with the light-emitting control signal line to receive the light-emitting control signal EM. The light-emitting control circuit 140 comprises a fourth transistor T4. A first end of the fourth transistor T4 is connected with the second node N2, a second end of the fourth transistor T4 is connected with a fourth node N4, and a gate electrode of the fourth transistor T4 is connected with the light-emitting control signal line to receive the light-emitting control signal EM. The organic light-emitting diode OLED comprises a first end connected with the fourth node N4 and a second end connected with a second power line to receive a second power voltage Vss. The sequence diagram of the pixel circuit 100 is illustrated in FIG. 11.

Figure 11:
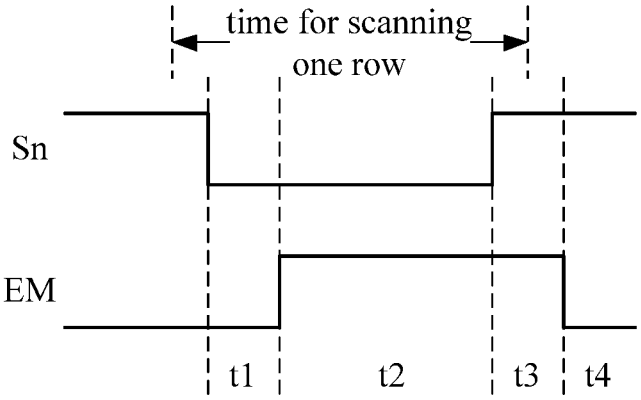
FIG. 11 is a first sequence diagram of a pixel circuit provided by an embodiment of the present disclosure.

For example, as illustrated in FIG. 11, during the reset period t1, the first control signal Sn is a switching-on voltage, and the light-emitting control signal EM is a switching-on voltage; during the data write period t2, the first control signal Sn is a switching-on voltage and the light-emitting control signal EM is a switching-off voltage; during the switching induced error compensation period t3, the first control signal Sn is a switching-off voltage and the light-emitting control signal EM is a switching-off voltage; and during the light-emitting period t4, the first control signal Sn is a switching-off voltage and the light-emitting control signal EM is a switching-on voltage.

It should be noted that the switching-on voltage means a voltage that can electrically connect the first end and the second end of a corresponding transistor, and the switching-off voltage means a voltage that can disconnect the first end and the second end of the corresponding transistor. When the transistor is a P-type transistor, the switching-on voltage is a low level voltage (e.g., 0V), and the switching-off voltage is a high level voltage (e.g., 5V). When the transistor is an N-type transistor, the switching-on voltage is a high level voltage (e.g., 5V), and the switching-off voltage is a low level voltage (e.g., 5V). The P-type transistor is taken as an example in the illustrations of the driving sequence of FIG. 11 to FIG. 13, that is, the switching-on voltage is a low level voltage (e.g., 0V), and the switching-off voltage is a high level voltage (e.g., 5V).

For example, the working procedure of the pixel circuit 100 is illustrated, taking the pixel circuit 100 illustrated in FIG. 2 and the driving sequence illustrated in FIG. 11 as an example.

For example, during the reset period t1, the first control signal Sn is a low level voltage, and the light-emitting control signal is a low level voltage. The first transistor T1, the second transistor T2, the third transistor T3 and the fourth transistor T4 all switch on (the source electrode and the drain electrode are electrically connected). The third transistor T3 writes the first reference voltage Vref1 into the third node N3 and the voltage of the third node N3 is the first reference voltage Vref1. The second power voltage Vss is written into the first node N1 through the fourth transistor T4 and the first transistor T1 and the voltage of the first node N1 is the second power voltage Vss. In this way, the pixel circuit 100 is reset.

During the data write period t2, the first control signal Sn is a low level voltage and the light-emitting control signal EM is a high level voltage. The first transistor T1 and the second transistor T2 switch on, and the third transistor T3 and the fourth transistor T4 switch off (the source electrode and the drain electrode are disconnected). The second transistor T2 writes the data signal Vdt into the third node N3, the voltage of the third node N3 is Vdt, and the voltage of the first node N1 is Vdd+Vth. Vth is the threshold voltage of the driving transistor DT, and the voltage difference of the first capacitor C1 is Vdd+Vth−Vdt.

During the switching induced error compensation period t3, the first control signal Sn is a high level voltage and the light-emitting control signal EM is a high level voltage. The first transistor T1, the second transistor T2, the third transistor T3 and the fourth transistor T4 all switch off. The voltage difference between the two ends of the first capacitor C1 is maintained to be Vdd+Vth−Vdt. Because the first compensation transistor TC1 also has an equivalent capacitor, and at the same time when the first transistor T1 switches off, the electric charges released by the equivalent capacitor between the gate electrode and the drain electrode of the first transistor T1 can be partly or wholly absorbed by the equivalent capacitor of the first compensation transistor TC1, so as to maintain that the threshold voltage stored in the first capacitor C1 is correct and stable. Because the first compensation transistor TC1 and the first transistor T1 are formed by the same process and the characteristics of the first compensation transistor TC1 and the first transistor T1 are same or similar, the equivalent capacitor of the first compensation transistor TC1 can exactly absorb the electric charges released by the equivalent capacitor of the first transistor T1.

During the light-emitting period t4, the first control signal Sn is a high level voltage and the light-emitting control signal EM is a low level voltage. The first transistor T1 and the second transistor T2 switch off, and the third transistor T3 and the fourth transistor T4 switch on. The third transistor T3 writes the first reference voltage Vref1 into the third node N3 for the second time, and the voltage of the third node N3 is the first reference voltage Vref1. At this point, because of the bootstrap effect of the first capacitor C1, the voltage of the first node N1 changes to Vref1+Vdd+Vth−Vdt. A light-emitting current holed runs into the organic light-emitting diode OLED through the driving transistor DT and the fourth transistor T4, and the organic light-emitting diode OLED emit light. The light-emitting current holed satisfies the following equation of the saturation current:

$$K(Vgs-Vth)^2=K(Vref1+Vdd+Vth-Vdt-Vdd-Vth)^2=K(Vref1-Vdt)^2$$

wherein $$K=0.5\mu_n Cox\frac{W}{L},$$

$\mu_n$ is the channel mobility of the driving transistor, Cox is the channel capacitance per unit area of the driving transistor, W and L are the channel with and the channel length respectively, and $V_{DTgs}$ is a gate-source voltage of the driving transistor DT' (i.e., a voltage difference between the gate electrode and the source electrode of the driving transistor DT').

As can be seen from the above equation, the current running through the OLED has nothing to do with the threshold voltage of the driving transistor DT. Therefore, the pixel circuit illustrated in FIG. 2 can compensate the threshold voltage of driving transistor DT.

For example, in one example, in the driving method provided by an embodiment of the present disclosure, the pixel circuit as illustrated in FIG. 3 or FIG. 4 is referred to, that is, the pixel circuit 100 comprises a driving transistor DT, a first transistor T1, a first capacitor C1, an organic light-emitting diode OLED, a switching induced error compensation circuit 110, a data write circuit 120, a first reference voltage write circuit 130, a light-emitting control circuit 140, a second reference voltage write circuit 150 and a discharge circuit 160. The pixel circuit illustrated in FIG. 4 further comprises a second capacitor C2. The driving transistor DT comprises a first end connected with a first power line to receive a first power voltage Vdd, a gate electrode connected with a first node N1, and a second end connected with a second node N2. The first transistor T1 comprises a first end connected with the second node N2, a gate electrode connected with a first control signal line to receive a first control signal Sn, and a second end connected with the first node N1. The first capacitor C1 comprises a first end connected with the first node N1 and a second end connected with a third node N3. The organic light-emitting diode OLED is configured to emit light driven by the driving transistor DT in operation. The switching induced error compensation circuit 110 comprises a first compensation transistor TC1. A first end and a second end of the first compensation transistor TC1 are connected with the first node N1, and a gate electrode of the first compensation transistor TC1 is connected with a light-emitting control signal line to receive a light-emitting control signal EM. The data write circuit 120 comprises a second transistor T2. A first end of the second transistor T2 is connected with the data signal line to receive the data signal Vdt, a second end of the second transistor T2 is connected with the third node N3, and a gate electrode of the second transistor T2 is connected with the first control signal line to receive the first control signal Sn. The first reference voltage write circuit 130 comprises a third transistor T3. A first end of the third transistor T3 is connected with a first reference voltage line to receive the first reference voltage Vref1, a second end of the third transistor T3 is connected with the third node N3, and a gate electrode of the third transistor T3 is connected with the light-emitting control signal line to receive the light-emitting control signal EM. The light-emitting control circuit 140 comprises a fourth transistor T4. A first end of the fourth transistor T4 is connected with the second node N2, a second end of the fourth transistor T4 is connected with a fourth node N4, and a gate electrode of the fourth transistor T4 is connected with the light-emitting control signal line to receive the light-emitting control signal EM. The organic light-emitting diode OLED comprises a first end connected with the fourth node N4 and a second end connected with a second power line to receive a second power voltage Vss. The second reference voltage write circuit 150 comprises a fifth transistor T5. A first end of the fifth transistor T5 is connected with a second reference voltage line to receive the second reference voltage Vref2, a second end of the fifth transistor T5 is connected with the third node N3, and a gate electrode of the fifth transistor T5 is connected with a second control signal to receive the second control signal Sn−1. The discharge circuit 160 comprises a sixth transistor T6. A first end of the sixth transistor T6 is connected with the first node N1, a second end of the sixth transistor T6 is connected with a discharge voltage line to receive the discharge voltage Vini, and a gate electrode of the sixth transistor T6 is connected with a second control signal line to receive the second control signal Sn−1. In the pixel circuit illustrated in FIG. 4, the first end of the second capacitor C2 is connected with a first power line to receive a first power voltage Vdd, and the second end of the second capacitor C2 is connected with the first node N1. The sequence diagram of the pixel circuit 100 is illustrated in FIG. 12.

Figure 12:
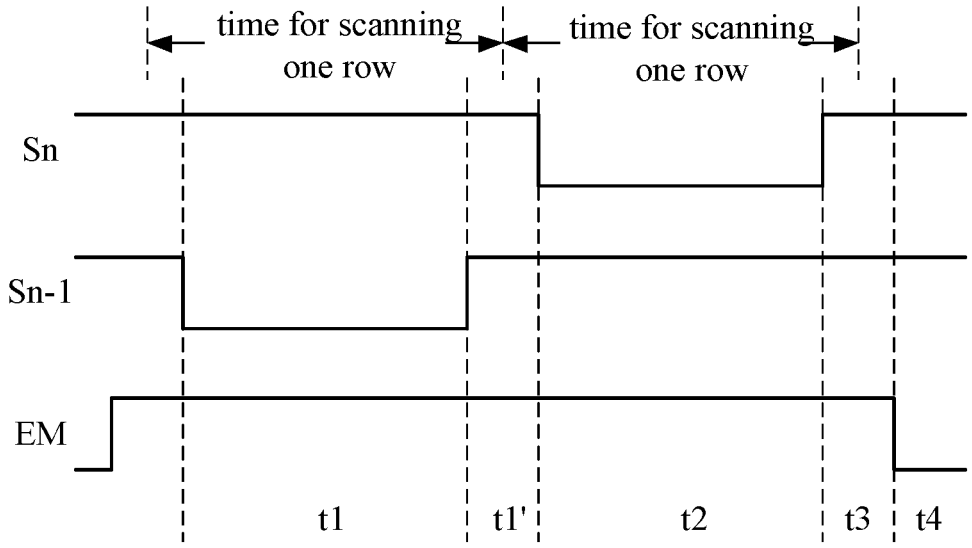
FIG. 12 is a second sequence diagram of a pixel circuit provided by an embodiment of the present disclosure.

For example, as illustrated in FIG. 12, during the reset period t1, the first control signal Sn is a switching-off voltage, the second control signal Sn−1 is a switching-on voltage and the light-emitting control signal EM is a switching-on voltage; during the data write period t2, the first control signal Sn is a switching-on voltage, the second control signal Sn−1 is a switching-off voltage and the light-emitting control signal EM is a switching-off voltage; during the switching induced error compensation period t3, the first control signal Sn is a switching-off voltage, the second control signal Sn−1 is a switching-off voltage and the light-emitting control signal EM is a switching-off voltage; and during the light-emitting period t4, the first control signal Sn is a switching-off voltage, the second control signal Sn−1 is a switching-off voltage and the light-emitting control signal EM is a switching-on voltage.

For example, the driving method of the pixel circuit 100 as illustrated in FIG. 3 or FIG. 4 can further comprise a reset stabilization period t1', which is provided between the reset period t1 and the data write period t2. During the reset stabilization period t1', the first control signal Sn is a switching-off voltage, the second control signal Sn−1 is a switching-off voltage and the light-emitting control signal EM is a switching-off voltage. For example, the reset stabilization period t1' can provide a stable period after circuit reset, so as to improve circuit stability.

For example, in one example, in the driving method provided by an embodiment of the present disclosure, the pixel circuit as illustrated in FIG. 6 is referred to, that is, the pixel circuit 100 comprises a driving transistor DT, a first transistor T1, a first capacitor C1, an organic light-emitting diode OLED, a switching induced error compensation circuit 110, a data write circuit 120, a first reference voltage write circuit 130, a light-emitting control circuit 140. The driving transistor DT comprises a first end connected with a first power line to receive a first power voltage Vdd, a gate electrode connected with a first node N1, and a second end connected with a second node N2. The first transistor T1 comprises a first end connected with the second node N2, a gate electrode connected with a first control signal line to receive a first control signal Sn, and a second end connected with the first node N1. The first capacitor C1 comprises a first end connected with the first node N1 and a second end connected with a third node N3. The organic light-emitting diode OLED is configured to emit light driven by the driving transistor DT in operation. The switching induced error compensation circuit 110 comprises a compensation capacitor CC. A first end of the compensation capacitor CC is connected with the first node N1, and a second end of the compensation capacitor CC is connected with the second node N2. The data write circuit 120 comprises a second transistor T2. A first end of the second transistor T2 is connected with the data signal line to receive the data signal Vdt, a second end of the second transistor T2 is connected with the third node N3, and a gate electrode of the second transistor T2 is connected with the first control signal line to receive the first control signal Sn. The first reference voltage write circuit 130 comprises a third transistor T3. A first end of the third transistor T3 is connected with a first reference voltage line to receive the first reference voltage Vref1, a second end of the third transistor T3 is connected with the third node N3, and a gate electrode of the third transistor T3 is connected with the light-emitting control signal line to receive the light-emitting control signal EM. The light-emitting control circuit 140 comprises a fourth transistor T4. A first end of the fourth transistor T4 is connected with the second node N2, a second end of the fourth transistor T4 is connected with a fourth node N4, and a gate electrode of the fourth transistor T4 is connected with the light-emitting control signal line to receive the light-emitting control signal EM. The organic light-emitting diode OLED comprises a first end connected with the fourth node N4 and a second end connected with a second power line to receive a second power voltage Vss. The sequence diagram of the pixel circuit 100 is illustrated in FIG. 11.

For example, as illustrated in FIG. 11, during the reset period t1, the first control signal Sn is a switching-on voltage, and the light-emitting control signal EM is a switching-on voltage; during the data write period t2, the first control signal Sn is a switching-on voltage and the light-emitting control signal EM is a switching-off voltage; during the switching induced error compensation period t3, the first control signal Sn is a switching-off voltage and the light-emitting control signal EM is a switching-off voltage; and during the light-emitting period t4, the first control signal Sn is a switching-off voltage and the light-emitting control signal EM is a switching-on voltage.

For example, in one example, in the driving method provided by an embodiment of the present disclosure, for the pixel circuit as illustrated in FIG. 8, that is, the pixel circuit 100 comprises a driving transistor DT, a first transistor T1, a first capacitor C1, an organic light-emitting diode OLED, a switching induced error compensation circuit 110, a data write circuit 120, a first reference voltage write circuit 130, a light-emitting control circuit 140. The driving transistor DT comprises a first end connected with a first power line to receive a first power voltage Vdd, a gate electrode connected with a first node N1, and a second end connected with a second node N2. The first transistor T1 comprises a first end connected with the second node N2, a gate electrode connected with a first control signal line to receive a first control signal Sn, and a second end connected with the first node N1. The first capacitor C1 comprises a first end connected with the first node N1 and a second end connected with a third node N3. The organic light-emitting diode OLED is configured to emit light driven by the driving transistor DT in operation. The switching induced error compensation circuit 110 comprises a second compensation transistor TC2. A first end of the second compensation transistor TC2 is connected with the second node N2, a second end of the second compensation transistor TC2 is connected with a discharge voltage line to receive a discharge voltage Vini, and a gate electrode of the second compensation transistor TC2 is connected with a compensation control signal line to receive a compensation control signal NSn. The data write circuit 120 comprises a second transistor T2. A first end of the second transistor T2 is connected with the data signal line to receive the data signal Vdt, a second end of the second transistor T2 is connected with the third node N3, and a gate electrode of the second transistor T2 is connected with the first control signal line to receive the first control signal Sn. The first reference voltage write circuit 130 comprises a third transistor T3. A first end of the third transistor T3 is connected with a first reference voltage line to receive the first reference voltage Vref1, a second end of the third transistor T3 is connected with the third node N3, and a gate electrode of the third transistor T3 is connected with the light-emitting control signal line to receive the light-emitting control signal EM. The light-emitting control circuit 140 comprises a fourth transistor T4. A first end of the fourth transistor T4 is connected with the second node N2, a second end of the fourth transistor T4 is connected with a fourth node N4, and a gate electrode of the fourth transistor T4 is connected with the light-emitting control signal line to receive the light-emitting control signal EM. The organic light-emitting diode OLED comprises a first end connected with the fourth node N4 and a second end connected with a second power line to receive a second power voltage Vss. The sequence diagram of the pixel circuit 100 is illustrated in FIG. 13.

Figure 13:
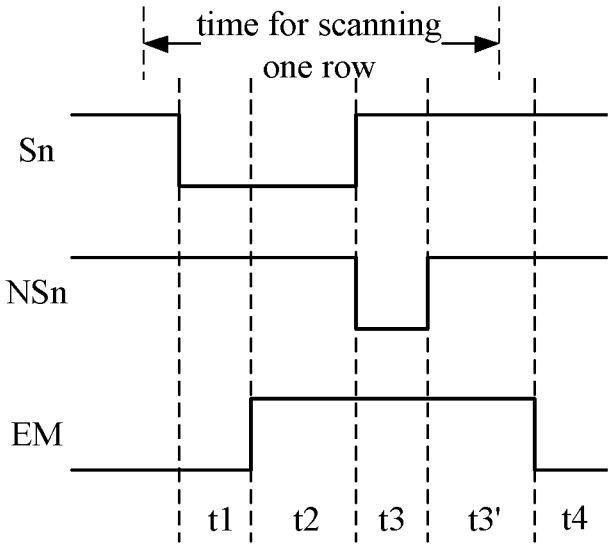
FIG. 13 is a third sequence diagram of a pixel circuit provided by an embodiment of the present disclosure.

For example, as illustrated in FIG. 13, during the reset period t1, the first control signal Sn is a switching-on voltage, the compensation control signal NSn is a switching-off voltage and the light-emitting control signal EM is a switching-on voltage; during the data write period t2, the first control signal Sn is a switching-on voltage, the compensation control signal NSn is a switching-off voltage and the light-emitting control signal EM is a switching-off voltage; during the switching induced error compensation period t3, the first control signal Sn is a switching-off voltage, the compensation control signal NSn is a switching-on voltage and the light-emitting control signal EM is a switching-off voltage; and during the light-emitting period t4, the first control signal Sn is a switching-off voltage, the compensation control signal NSn is a switching-off voltage and the light-emitting control signal EM is a switching-on voltage.

For example, as illustrated in FIG. 13, the driving method of the pixel circuit 100 as illustrated in FIG. 8 can further comprise a compensation stabilization period t3', which is provided between the switching induced error compensation period t3 and the light-emitting period t4. During the compensation stabilization period t3', the first control signal Sn is a switching-off voltage, the compensation control signal NSn is a switching-off voltage and the light-emitting control signal EM is a switching-off voltage. For example, compensation stabilization period t3' can provide a stable period for the circuit after switching induced error compensation, so as to improve circuit stability.

For example, as illustrated in FIG. 13, in the driving method of the pixel circuit 100 as illustrated in FIG. 8, when the first control signal Sn changes from a switching-on voltage to a switching-off voltage, the compensation control signal NSn changes from a switching-off voltage to a switching-on voltage concurrently. That is to say, at the transition point of the data write period t2 and the switching induced error compensation period t3, when the first control signal Sn changes from a switching-on voltage to a switching-off voltage, the compensation control signal NSn changes from a switching-off voltage to a switching-on voltage concurrently.

The pixel circuit, display panel, display device and the driving method provided by the embodiments of the present disclosure can reduce or eliminate the switching induced error during the compensation for the threshold voltage and improve the display uniformity of the display panel.

Although detailed description has been given above to the present disclosure with general description and embodiments, it shall be apparent to those skilled in the art that some modifications or improvements may be made on the basis of the embodiments of the present disclosure. Therefore, all the modifications or improvements made without departing from the spirit of the present disclosure shall all fall within the scope of protection of the present disclosure.

The application claims priority to the Chinese patent application No. 201611014202.7, filed on Nov. 18, 2016, the entire disclosure of which is incorporated herein by reference as part of the present application.

What is claimed is:

1. A pixel circuit, comprising:

a driving transistor, comprising a first end connected with a first power line to receive a first power voltage, a gate electrode connected with a first node, and a second end connected with a second node;

a first transistor, comprising a first end connected with the second node, a gate electrode connected with a first control signal line to receive a first control signal, and a second end connected with the first node;

a first capacitor, comprising a first end connected with the first node and a second end connected with a third node;

an organic light-emitting diode, configured to emit light driven by the driving transistor in operation; and a switching induced error compensation circuit, configured to compensate a switching induced error of the first transistor, wherein the switching induced error compensation circuit comprises a first compensation transistor, a first end and/or a second end of the first compensation transistor is connected with the first node, and a gate electrode of the first compensation transistor is connected with a light-emitting control signal line to receive a light-emitting control signal.

2. The pixel circuit according to claim 1, wherein the first compensation transistor and the first transistor are formed by a same process.

3. The pixel circuit according to claim 1, further comprising a data write circuit, wherein the data write circuit comprises a second transistor, a first end of the second transistor is connected with a data signal line to receive a data signal, a second end of the second transistor is connected with the third node, and a gate electrode of the second transistor is connected with the first control signal line to receive the first control signal.

4. The pixel circuit according to claim 1, further comprising a first reference voltage write circuit, wherein the first reference voltage write circuit comprises a third transistor, a first end of the third transistor is connected with a first reference voltage line to receive the first reference voltage, a second end of the third transistor is connected with the third node, and a gate electrode of the third transistor is connected with the light-emitting control signal line to receive the light-emitting control signal.

5. The pixel circuit according to claim 1, further comprising:

a light-emitting control circuit, comprising a fourth transistor, wherein a first end of the fourth transistor is connected with the second node, a second end of the fourth transistor is connected with a fourth node, and a gate electrode of the fourth transistor is connected with the light-emitting control signal line to receive the light-emitting control signal; and the organic light-emitting diode comprises a first end connected with the fourth node and a second end connected with a second power line to receive a second power voltage.

6. The pixel circuit according to claim 1, further comprising:

a second reference voltage write circuit, configured to receive a second control signal and a second reference voltage, and to write the second reference voltage into the third node according to the second control signal.

7. The pixel circuit according to claim 1, further comprising:

a discharge circuit, comprising a sixth transistor, wherein a first end of the sixth transistor is connected with the first node, a second end of the sixth transistor is connected with a discharge voltage line to receive a discharge voltage, and a gate electrode of the sixth transistor is connected with a second control signal line to receive a second control signal.

8. The pixel circuit according to claim 1, further comprising a second capacitor, wherein a first end of the second capacitor is connected with the first power line to receive the first power voltage, and a second end of the second capacitor is connected with the first node.

9. A display panel, comprising the pixel circuit of claim 1, the first power line, and the first control signal line.

10. A display device, comprising the display panel of claim 9.

11. A pixel circuit, comprising:

a driving transistor, comprising a first end connected with a first power line to receive a first power voltage, a gate electrode connected with a first node, and a second end connected with a second node;

a first transistor, comprising a first end connected with the second node, a gate electrode connected with a first control signal line to receive a first control signal, and a second end connected with the first node;

a first capacitor, comprising a first end connected with the first node and a second end connected with a third node;

an organic light-emitting diode, configured to emit light driven by the driving transistor in operation;

a switching induced error compensation circuit, comprising a compensation capacitor, a first end of the compensation capacitor is connected with the first node, and a second end of the compensation capacitor is connected with the second node; and a data write circuit, comprising a second transistor, wherein a first end of the second transistor is connected with a data signal line to receive a data signal, a second end of the second transistor is connected with the third node, and a gate electrode of the second transistor is connected with the first control signal line to receive the first control signal.

12. A pixel circuit, comprising:

a driving transistor, comprising a first end connected with a first power line to receive a first power voltage, a gate electrode connected with a first node, and a second end connected with a second node;

a first transistor, comprising a first end connected with the second node, a gate electrode connected with a first control signal line to receive a first control signal, and a second end connected with the first node;

a first capacitor, comprising a first end connected with the first node and a second end connected with a third node;

an organic light-emitting diode, configured to emit light driven by the driving transistor in operation; and a switching induced error compensation circuit, comprising a compensation transistor, a first end of the compensation transistor is connected with the second node, a second end of the compensation transistor is connected with a discharge voltage line to receive a discharge voltage, and a gate electrode of the compensation transistor is connected with a compensation control signal line to receive a compensation control signal.

13. A driving method of a pixel circuit, wherein the pixel circuit comprises a driving transistor, comprising a first end connected with a first power line to receive a first power voltage, a gate electrode connected with a first node, and a second end connected with a second node; a first transistor, comprising a first end connected with the second node, a gate electrode connected with a first control signal line to receive a first control signal, and a second end connected with the first node; a first capacitor, comprising a first end connected with the first node and a second end connected with a third node; an organic light-emitting diode, configured to emit light driven by the driving transistor in operation; and a switching induced error compensation circuit, connected with the first node and/or the second node and configured to compensate a switching induced error of the first transistor, wherein the switching induced error compensation circuit comprises a first compensation transistor, a first end and/or a second end of the first compensation transistor is connected with the first node, and a gate electrode of the first compensation transistor is connected with a light-emitting control signal line to receive a light-emitting control signal, wherein the driving method comprises a reset period, a data write period, a switching induced error compensation period, and a light-emitting period, wherein during the reset period, the first node is reset;

during the data write period, a data signal is written in;

during the switching induced error compensation period, the switching induced error of the first transistor is compensated; and during the light-emitting period, the organic light-emitting diode is driven to emit light.

14. The driving method according to claim 13, wherein during the data write period, the first control signal is a switching-on voltage and the light-emitting control signal is a switching-off voltage;

during the switching induced error compensation period, the first control signal is the switching-off voltage and the light-emitting control signal is the switching-off voltage; and during the light-emitting period, the first control signal is the switching-off voltage and the light-emitting control signal is the switching-on voltage.

15. The driving method according to claim 13, wherein the switching induced error compensation circuit comprises a compensation capacitor; a first end of the compensation capacitor is connected with the first node, and a second end of the compensation capacitor is connected with the second node; wherein during the data write period, the first control signal is a switching-on voltage and the light-emitting control signal is a switching-off voltage;

during the switching induced error compensation period, the first control signal is the switching-off voltage and the light-emitting control signal is the switching-off voltage; and during the light-emitting period, the first control signal is the switching-off voltage and the light-emitting control signal is the switching-on voltage.

16. The driving method according to claim 13, wherein the switching induced error compensation circuit comprises a second compensation transistor; a first end of the second compensation transistor is connected with the second node, a second end of the second compensation transistor is connected with a discharge voltage line to receive a discharge voltage, and a gate electrode of the second compensation transistor is connected with a compensation control signal line to receive a compensation control signal, wherein during the data write period, the first control signal is a switching-on voltage, the light-emitting control signal is a switching-off voltage, and the compensation control signal is the switching-off voltage;

during the switching induced error compensation period, the first control signal is the switching-off voltage, the light-emitting control signal is the switching-off voltage, and the compensation control signal is the switching-on voltage; and during the light-emitting period, the first control signal is the switching-off voltage, the light-emitting control signal is the switching-on voltage, and the compensation control signal is switching-off voltage.

17. The driving method according to claim 16, wherein when the first control signal changes from the switching-on voltage to the switching-off voltage, the compensation control signal changes from the switching-off voltage to the switching-on voltage concurrently.

* * * * *